US007095821B2

(12) United States Patent
Steinlage et al.

(10) Patent No.: US 7,095,821 B2
(45) Date of Patent: Aug. 22, 2006

(54) NON-RUSTING AND NON-PARTICULATING IMAGING X-RAY TUBE ROTOR ASSEMBLY

(75) Inventors: Gregory A. Steinlage, Milwaukee, WI (US); Alexander M. Blok, Milwaukee, WI (US); Mohamed Osama, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/604,498

(22) Filed: Jul. 25, 2003

(65) Prior Publication Data

US 2005/0018816 A1 Jan. 27, 2005

(51) Int. Cl.
*H01J 35/10* (2006.01)
*H01J 35/26* (2006.01)

(52) U.S. Cl. ..... 378/131; 378/129; 310/85; 310/211; 310/262

(58) Field of Classification Search ..... 378/125–131; 310/211, 212, 216, 261, 265, 271, 85, 86, 310/262

See application file for complete search history.

(56) References Cited

U.S. PATENT DOCUMENTS 5,056,126 A * 10/1991 Klostermann et al. ..... 378/127
5,185,774 A * 2/1993 Klostermann ..... 378/125
5,506,881 A * 4/1996 Ono et al. ..... 378/125
5,553,114 A * 9/1996 Siemers et al. ..... 378/129
5,696,804 A * 12/1997 Ono et al. ..... 378/4
5,773,909 A * 6/1998 Hansen et al. ..... 310/261
6,144,720 A * 11/2000 DeCou et al. ..... 378/131
6,274,962 B1 * 8/2001 Kliman ..... 310/261
6,330,304 B1 * 12/2001 Warburton ..... 378/131
6,390,875 B1 * 5/2002 Warren et al. ..... 445/28
6,538,353 B1 * 3/2003 Marioni ..... 310/89
6,838,798 B1 * 1/2005 Takahata et al. ..... 310/156.53
6,856,065 B1 * 2/2005 Suzuki et al. ..... 310/218
6,906,448 B1 * 6/2005 Yoshino et al. ..... 310/216

* cited by examiner

*Primary Examiner*—Edward J. Glick
*Assistant Examiner*—Thomas R. Artman
(74) *Attorney, Agent, or Firm*—Peter J. Vogel

(57) ABSTRACT

An rotor assembly (30) for an imaging X-ray tube (32) is provided. The imaging X-ray tube rotor assembly (30) includes at least partially a magnetic non-corrosive material. A method of producing the imaging tube X-ray rotor assembly (30) is also provided including forming a rotor core (52) at least partially from a magnetic non-corrosive material.

24 Claims, 6 Drawing Sheets

NON-RUSTING AND NON-PARTICULATING IMAGING X-RAY TUBE ROTOR ASSEMBLY

BACKGROUND OF INVENTION

The present invention relates generally to diagnostic imaging systems containing a rotating anode X-ray tube. More particularly, the present invention relates to a non-rusting and non-particulating imaging tube rotor assembly and to a method for forming the same.

Various diagnostic imaging X-ray tube systems are presently used, each of which have different system functionality requirements. Because of the different functionality requirements, internal system components vary depending upon the application, the manufacturer, and the system model.

The imaging system includes an X-ray tube that contains an electric motor assembly for rotating an anode. The motor assembly generates a magnetic field that causes an X-ray tube rotor assembly, which is coupled to the anode, to rotate. In order for the X-ray tube to operate properly, the inside of the X-ray tube needs to be free of rust and particulate. Rust can directly and negatively affect rotating efficiency and emissitivity of the X-ray tube as well as create particulate, which may indirectly and also negatively affect X-ray tube operation. Particulate can also be created by spalling of coatings or layers on various X-ray tube components. Particulate within the X-ray tube not only negatively affects rotating efficiency and emissitivity like rust, but also may negatively affect other X-ray tube operation parameters, such as for example, X-ray production, which can degrade image quality. Rust and flaking may occur early in the production and use of an X-ray tube or may occur over time and usage of the X-ray tube.

A large amount of heat is generated within the X-ray tube. In order to dissipate the heat, a coating, having a high emissitivity value, is used over an exterior surface of the X-ray tube rotor assembly. The coating prevents degradation of X-ray tube components by radiating away the heat. Unfortunately, the coating layer tends to flake off over time and form more particulate, which further decreases the performance of the X-ray tube.

Traditionally, X-ray tube rotor assemblies are fabricated from a combination of copper, copper alloy, aluminum, and magnetic steel, or less frequently from a combination of copper, copper alloy, and aluminum. The magnetic steel forms a rotor core. The copper forms a conductive exterior surface on the rotor core. The magnetic steel is the conventional material of choice for the rotor core, due to its magnetic properties and consequential ability to produce electromagnetic torque.

An undesired result of oxidation and rusting has been encountered in production of the X-ray tube rotor assemblies that contain a steel core. The encountered rust is painstaking and costly to prevent and remove from the X-ray tube rotor assemblies.

Two types of X-ray tube rotor assembly design styles that are typically used include a "sheet" design and a "squirrel cage" design. The sheet design includes a copper, a copper alloy, or aluminum conductive sheet formed over a magnetic steel core. The squirrel cage design includes a steel core having integrally formed slots containing copper, copper alloy, or aluminum bars formed therein. Such bars may be exposed on the X-ray tube rotor assembly exterior surface or may be enclosed by the exterior surface of the rotor core. The bars are integrally formed along with a first end cap and a second end cap to form a single component. The squirrel cage design directs current along the bars between the two end caps, which allows for increased current flow, fewer power losses, and increased torque production over the sheet design. The use of either the sheet design or the squirrel cage design depends upon application requirements.

X-ray tube rotor assemblies of both the sheet design and the squirrel cage design have several associated disadvantages. Both designs have the propensity to develop rust over time, thereby generating particulate. Also, both designs have surfaces of low emissitivity, when left uncoated.

Therefore, it would be desirable to provide an improved apparatus and method for preventing generation of particulate within an X-ray tube.

SUMMARY OF INVENTION

The foregoing and other advantages are provided by an apparatus and method for a non-rusting and non-particulating imaging X-ray tube rotor assembly. The imaging X-ray tube rotor assembly includes at least partially a magnetic non-corrosive iron based material. A method of producing the imaging tube rotor assembly is also provided including forming a rotor core at least partially from a magnetic non-corrosive iron based invention is that it provides an imaging X-ray tube rotor assembly that is non-rusting and non-particulating. The present invention, thereby, decreases the probability for material.

One of several advantages of the present invention is that it provides an X-ray tube rotor assembly with high rotating efficiency arid emissitivity.

Another advantage of the present invention is that it has at least the performance ability of traditional X-ray tube rotor assemblies and has material properties for improved casting, welding, and brazing production activities.

Furthermore, an advantage of the present invention is that it has a coefficient of thermal expansion that prevents excessive internal stresses during fabrication, assembly, and operation of the X-ray tube rotor assembly.

Therefore, the present invention with the above-mentioned advantages in addition to other advantages significantly reduces handling costs associated with the prevention and removal of rust and particulate from traditional X-ray tube rotor assemblies.

The present invention itself, together with attendant advantages, will be best understood by reference to the following detailed description, taken in conjunction with the accompanying figures.

BRIEF DESCRIPTION OF DRAWINGS

For a more complete understanding of this invention reference should now be had to the embodiments illustrated in greater detail in the accompanying figures and described below by way of examples of the invention wherein.

DETAILED DESCRIPTION

Figure 1:
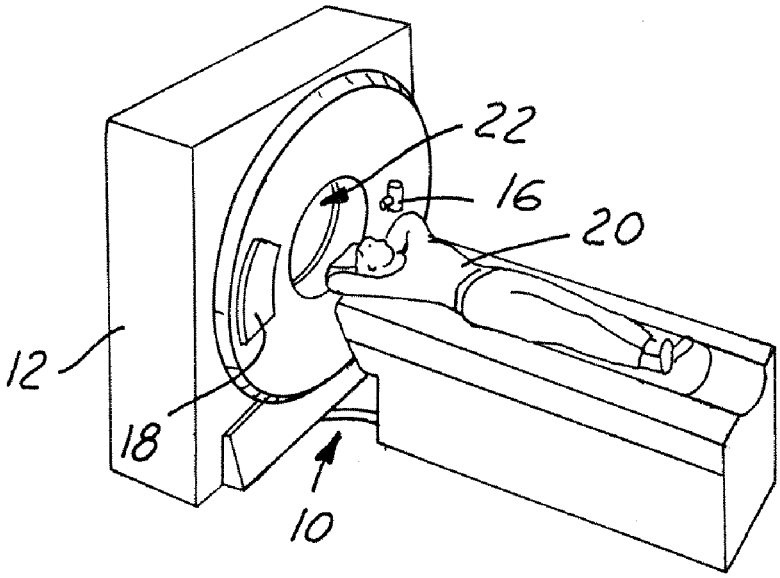
FIG. 1 is a pictorial view of a computed tomography (CT) system, utilizing a X-ray tube rotor assembly in accordance with an embodiment of the present invention.

In each of the following figures, the same reference numerals are used to refer to the same components. While the present invention is described with respect to an apparatus and method for a non-rusting and non-particulating CT tube rotor assembly, the present invention may be adapted to be used in various systems including: computed tomography (CT) systems, radiography systems, cardiography systems, angiography systems, fluoroscopy systems, mammography systems, and other imaging systems that use X-ray imaging tubes.

In the following description, two different CT tube rotor assembly designs are described for example and illustrative purposes only. The advantages of the present invention may also be incorporated in various other imaging X-ray tube rotor assembly designs.

In the following description, various operating parameters and components are described for one constructed embodiment. These specific parameters and components are included as examples and are not meant to be limiting.

Referring now to FIG. 1, a pictorial view of a CT system 10, utilizing a CT tube rotor assembly in accordance with an embodiment of the present invention is shown. The imaging system 10 includes a gantry 12 that has a CT imaging tube assembly 16. The assembly 16 projects a beam of x-rays toward a detector array 18. The x-rays, after passing through the patient 20, within the system bore 22, are detected and used to create a CT image.

Figure 2:
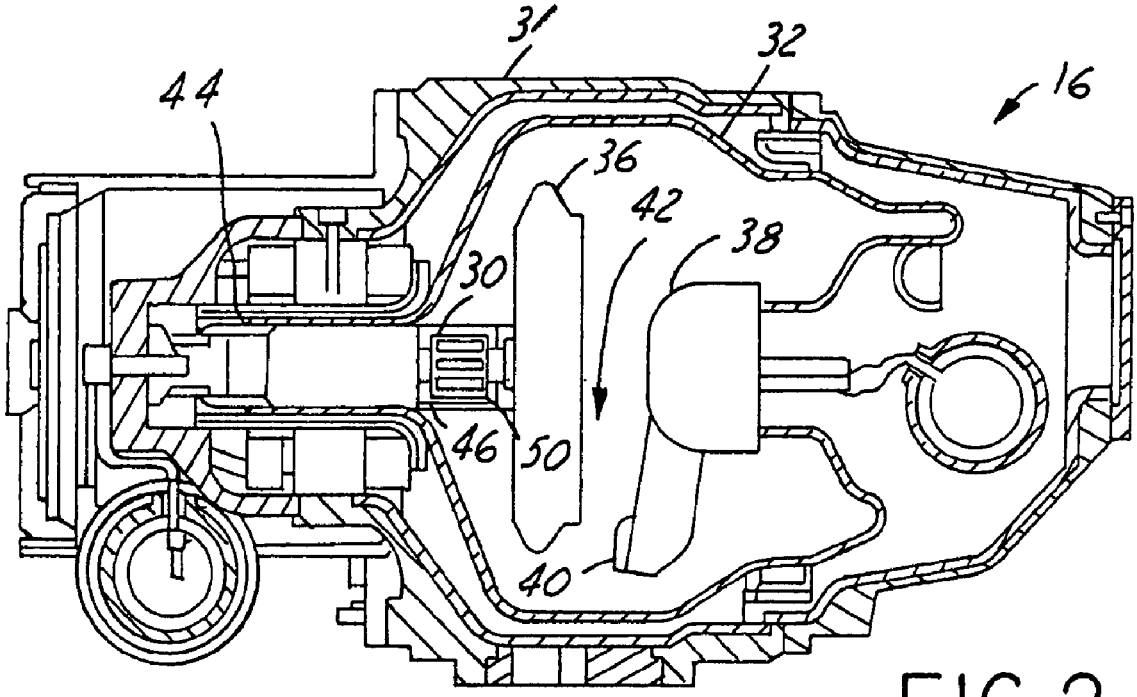
FIG. 2 is a cross-sectional view of a X-ray tube assembly utilizing a rotor assembly in accordance with an embodiment of the present invention.

Referring now to FIG. 2, a cross-sectional view of the assembly 16 utilizing a CT tube rotor assembly 30 in accordance with an embodiment of the present invention is shown. The assembly 16 includes an exterior housing 34 comprising a CT tube 32. The CT tube contains a rotating anode 36 and a cathode 38. The cathode 38 includes a thermionic emission element 40. Electrons pass from the emission element 40 to the rotating anode 36, across a vacuum gap 42, where they impinge on the anode 36 producing x-rays. These x-rays then pass through a window (not shown) in the housing 34 for scanning purposes.

The anode 36 is rotated by an electric motor 44 having a stator 46 and a rotor assembly 30. Electromagnetic energy passes from the stator 46 to the CT tube rotor assembly 30 to rotate the anode 36. A large amount of heat is generated within and during operation of the electric motor 44. In order to prevent degradation of rotor assembly components, due to the generated heat, at least a portion of an exterior surface 50 of the CT tube rotor assembly 30 may be coated as to have a high emissivity value and radiate heat during operation. Emissivity of exterior surfaces of the CT tube rotor assembly 30 is further described below.

Figure 3:
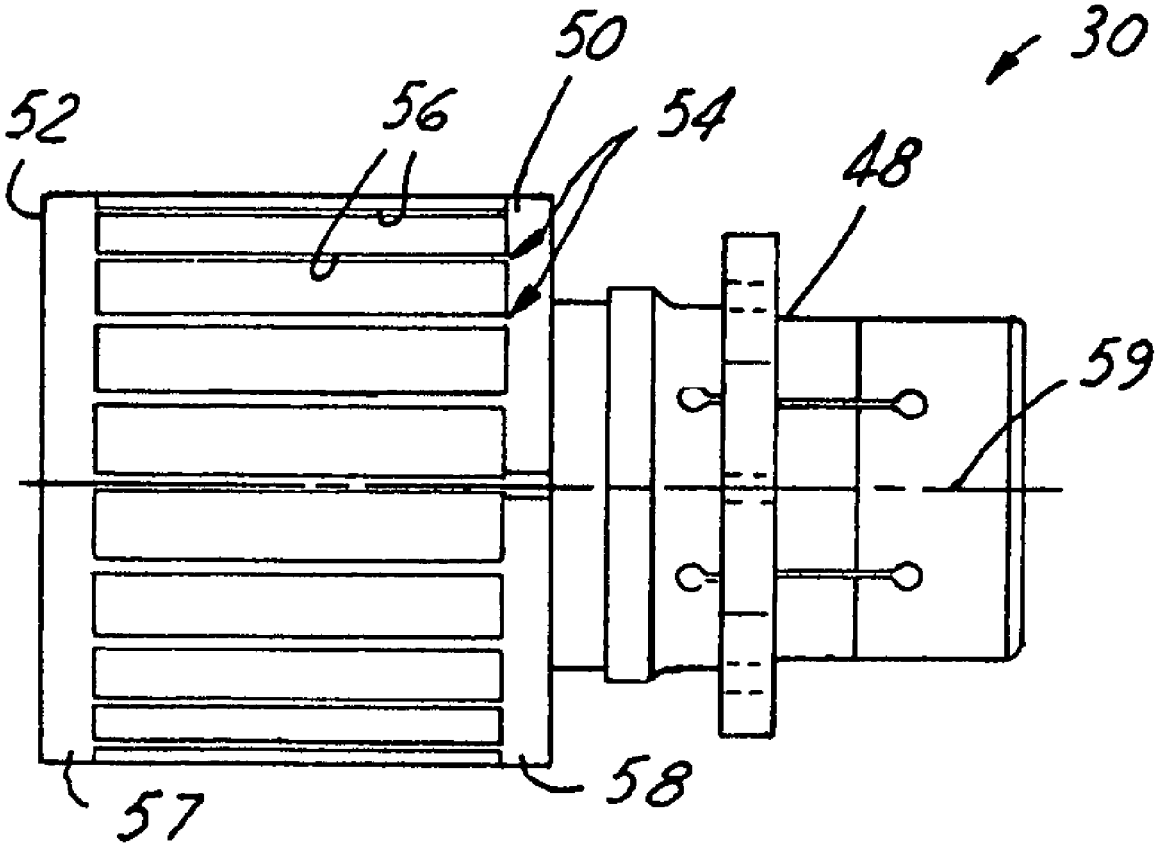
FIG. 3 is a side-view of the X-ray tube rotor assembly of FIG. 2 in accordance with an embodiment of the present invention.

Referring now to FIG. 3, a side-view of the CT tube rotor assembly 30 in accordance with an embodiment of the present invention is shown. The CT tube rotor assembly 30 includes a shaft 48 and a rotor core 52 having a series of slots 54 integrally formed therein and multiple bars 56. The bars 56 are formed within each of the slots 54. The bars 56 are integrally formed as a single component along with a first end cap 57 and a second end cap 58. The general design style of the CT tube rotor assembly 30 is referred to as a "squirrel cage" design, in the art.

The core 52 is produced from a magnetic non-corrosive iron based material to provide the desired torque and prevent formation of rust and particulate. The magnetic non-corrosive iron based material of the core 52 contains approximately at least 12% chromium. The chromium allows the external surface 50 of the core 52 to be oxidized to radiate heat. An example of a magnetic non-corrosive material that may be used is stainless steel. Stainless steel typically contains 12–17% chromium, which is adequate for coherent chromium oxidation purposes. A magnetic non-corrosive material, such as stainless steel, provides the electric motor 44 with a larger amount of torque and an increase in emissivity over traditional CT tube rotor assemblies. Certain types of stainless steel, such as 430SS, may also decrease anode acceleration times depending upon the components of a CT tube and the application. The shaft 48 and the core 52 are fabricated using machining techniques known in the art. The shaft 48 and the core 52 may be integrally formed as a single component or may be separate components.

The bars 56 and the end caps 57 and 58 are produced at least partially from a non-magnetic highly conductive material. Of course, the higher the percent of highly conductive material the higher the conductivity of the bars. The high conductivity allows ease of current flow. The non-magnetic highly conductive material may include at least one of the following: copper, aluminum, silver, nickel, cobalt, or an alloy containing at least two of the aforementioned materials, or another highly conductive material having similar manufacturing and production properties as the materials stated. Manufacturing and production properties refer to casting, welding, brazing, and other assembly and component forming activities involved in producing a CT tube rotor assembly. The bars 56 and the end caps 57 and 58 provide additional ease of electric current flow, in that they direct the flow along a centerline 59 of the CT tube rotor assembly 30.

Figure 4:
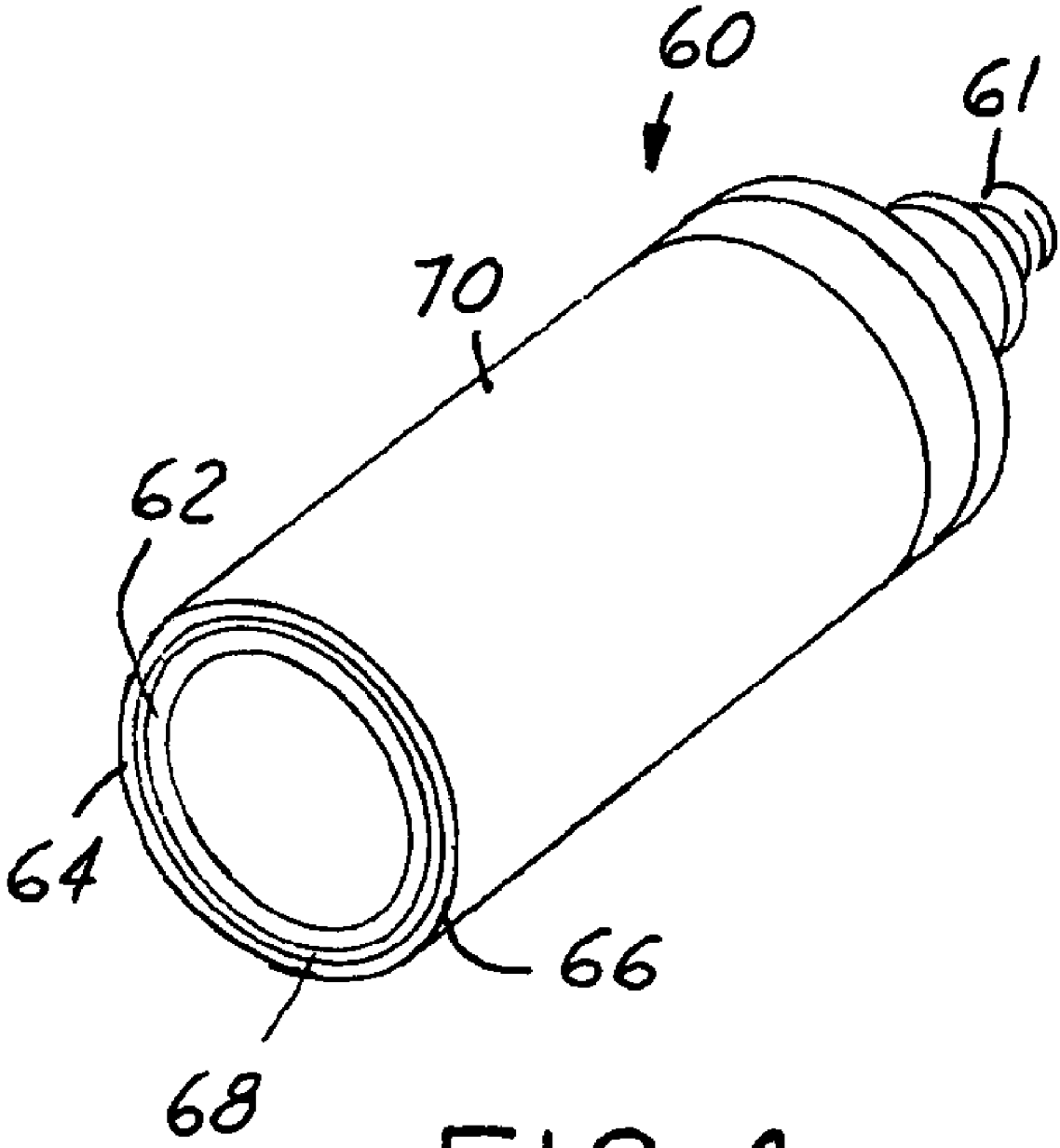
FIG. 4 is a perspective view of a X-ray tube rotor assembly in accordance with another embodiment of the present invention.

Referring now to FIG. 4, a perspective view of a CT tube rotor assembly 60 in accordance with another embodiment of the present invention is shown. The CT tube rotor assembly 60 generally portrays a "sheet" design CT tube rotor assembly. The CT tube rotor assembly 60 includes a shaft 61, a rotor core 62, a sheet 64, and a sleeve 66.

Although the core 62 as with the core 52 is produced from a magnetic non-corrosive material, the core 62 may be produced from a corrosive iron based material since the majority of the exterior surface area of the core 62 is covered by the sheet 64. The shaft 61 and the core 62 are also fabricated using machining techniques known in the art.

The sheet 64 covers a majority of an external side 68 of the core 62. The sheet 64 is produced from a non-magnetic highly conductive material. The sheet 64 also provides ease of current flow, but is not confined to individual slots.

The sleeve 66 covers a majority of the sheet 64 and is produced from a non-magnetic non-corrosive material such as stainless steel or chromium. One purpose of the sleeve 66 is to provide a thin oxidized external surface 70 over the sheet 64 so that the CT tube rotor assembly 60 has a high emissivity value. The sleeve 66 may also be used in preventing rust. The sleeve 66 is thin in proportion to the core 62 and the sheet 64 to prevent reduction in the amount of flux and the transfer of electromagnetic current to the sheet 64.

Although the CT tube rotor assembly 60 is illustrated having sheet 64 and sleeve 66, applications that have lower performance requirements may allow the use of the core 62 alone. In such an application, when the core 62 is used without the sheet 64 or the sleeve 66 the core 62 is produced from a magnetic non-corrosive material, such that an exterior surface may be oxidized.

Also, for applications when a large amount of current flow is desired, X-ray tube rotor assembly 30 is preferred over X-ray tube rotor assembly 60, due to its lower power losses, higher torque capability, and ability to maintain a high emissitivity value.

Figure 5:
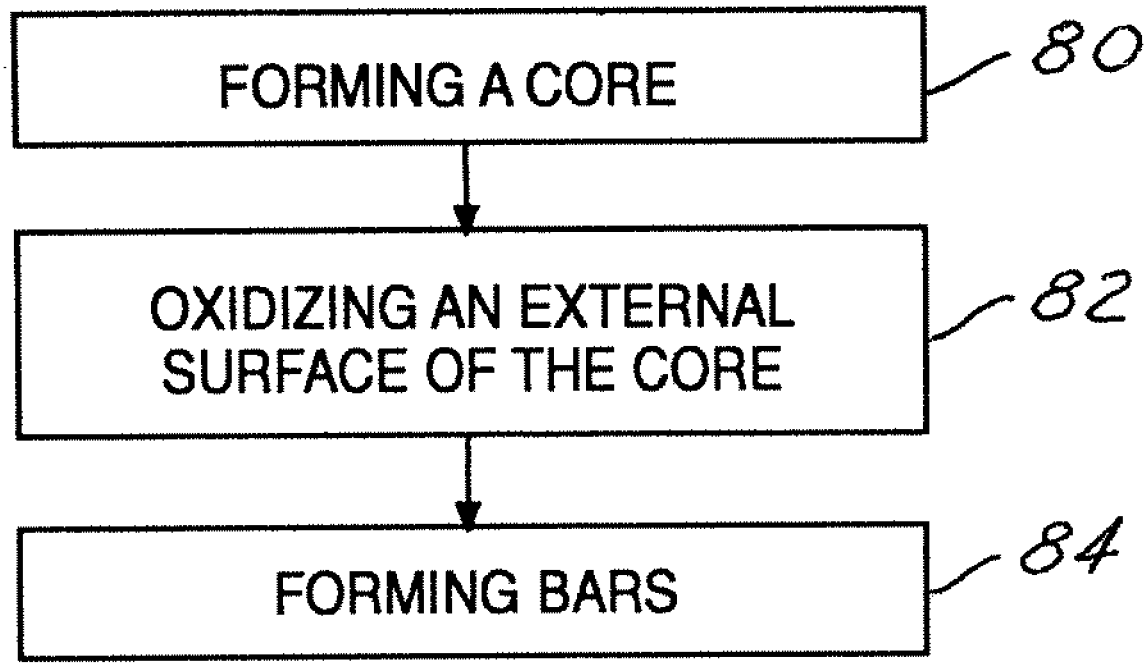
FIG. 5 is a logic flow diagram illustrating a method of producing the X-ray tube rotor assembly of FIG. 3 in accordance with an embodiment of the present invention.

Referring now to FIGS. 3 and 5, a logic flow diagram illustrating a method of producing the X-ray tube rotor assembly 30 in accordance with an embodiment of the present invention is shown.

The core 52 is formed at least partially from a magnetic non-corrosive material and integrally having the series of slots 54, as is described above and generally indicated by reference number 80.

The external surface 50 is oxidized, as is generally indicated by reference to number 82. Oxidation of the external surface 50 involves placing the core 52 in a furnace that is operating at high temperatures, to cause a "greening" effect of the external surface 50. The temperatures that the furnace is operated at depend upon the material to be oxidized. The greening effect causes the external surface to change to a dark green color and provides the desired emissitivity. The greening effect also does not rub off or flake off as with traditionally applied coatings or layers. Therefore, oxidation of a component to generate a greening effect changes the surface of the component to have a higher emissitivity value, which does not flake off and create particulate. A sleeve of non-magnetic non-rusting material may also be applied over the squirrel cage rotor, as in the embodiment for the sheet rotor.

Bars 56 are formed within the series of slots 54 along with the end caps 57 and 58, as is generally indicated by reference number 84.

Figure 6:
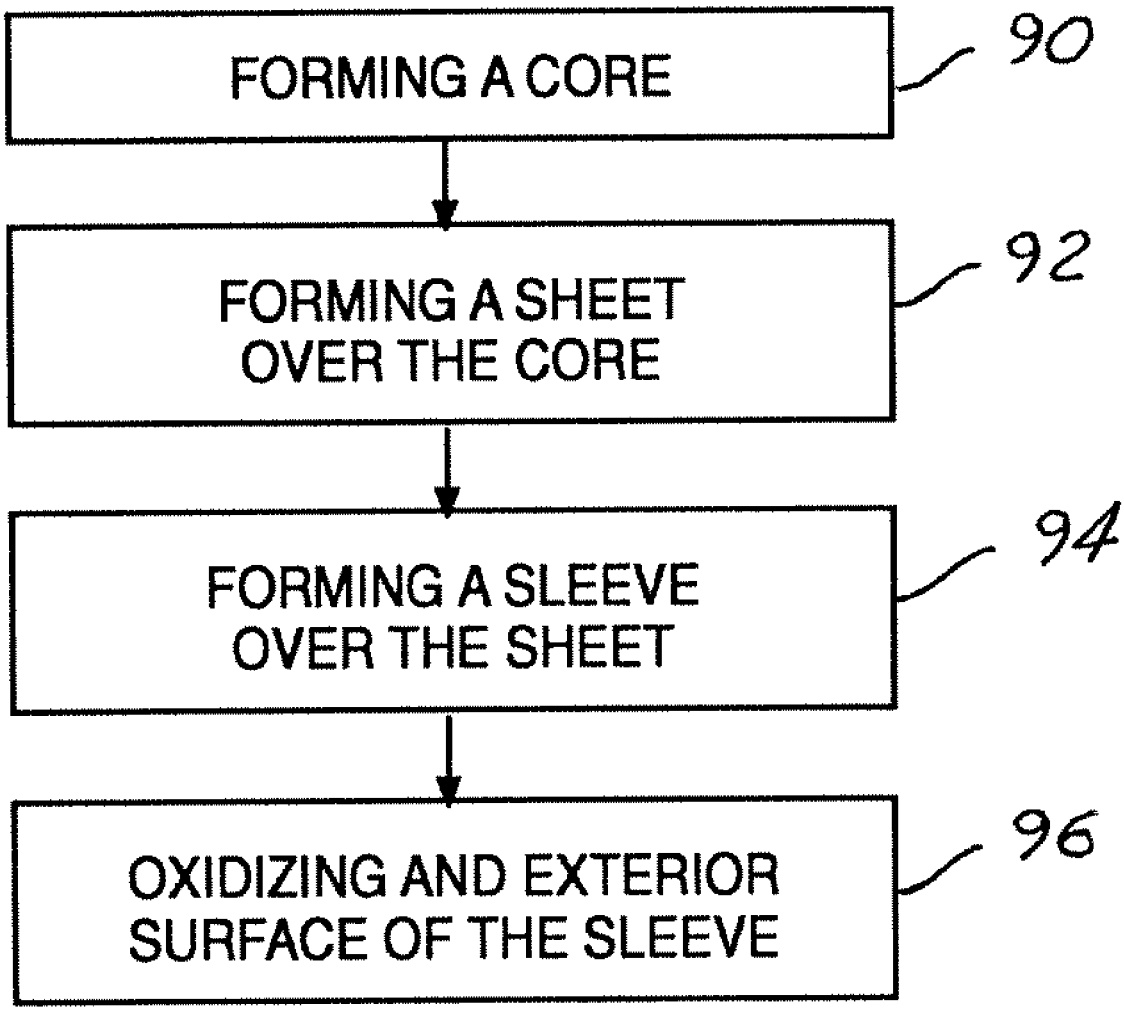
FIG. 6 is a logic flow diagram illustrating a method of producing the CT tube rotor assembly of FIG. 4 in accordance with another embodiment of the present invention.

Referring now to FIG. 6, a logic flow diagram illustrating a method of producing the sheet X-ray tube rotor assembly 60 in accordance with another embodiment of the present invention is shown.

The X-ray core 62 is formed at least partially from a magnetic non-corrosive material, as is generally indicated by reference number 90.

The sheet 64 is formed over the core 62 using a mechanical process known in the art, as is generally indicated by reference number 92.

The sleeve 66 is formed over the sheet 64 using a mechanical, chemical, or physical deposition process, as is also known in the art and is generally indicated by reference number 94.

The exterior surface 70 of the sleeve 66 is oxidized, as is generally described above in step 82 and indicated by reference number 96.

In an application when the sheet 64 and the sleeve 66 are not required, steps 92 and 94 may not be performed and in replacement of step 96 the exterior surface of the core 62 is oxidized, instead of oxidizing the exterior surface 70. The exterior surface of the core 62 may not be oxidized to prevent rust and particulation.

The above-described steps of FIGS. 5 and 6 are meant to be illustrative examples and may be easily modified depending upon the application. The steps may be performed sequentially, synchronously, simultaneously, or in a different order depending upon the application.

The present invention by providing an X-ray tube rotor assembly that is non-rusting, non-particulating, and having at least the performance of typical X-ray tube rotor assemblies, allows an X-ray tube to be produced and operated with fewer defects. The X-ray tube rotor assembly of the present invention also satisfies fabrication, assembly, and performance requirements of X-ray tube rotor assemblies.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

The invention claimed is:

1. An imaging X-ray tube rotor assembly for an imaging tube comprising:

a shaft;

an x-ray tube rotor core produced at least partially of a non-corrosive material and integrally formed as a single component with said shaft comprising;

at least one slot; and at least one bar; and a non-sprayed-on non-corrosive sleeve directly coupled to, at least partially covering, and rotational with said rotor core.

2. An imaging X-ray tube rotor assembly as in claim 1 wherein said rotor core is produced at least partially from a magnetic non-corrosive material.

3. An imaging X-ray tube rotor assembly as in claim 1 wherein said rotor core approximately comprises at least 12% chromium.

4. An imaging X-ray tube rotor assembly as in claim 1 wherein said rotor core at least partially comprises stainless steel.

5. An imaging X-ray tube rotor assembly as in claim 1 wherein said non-sprayed-on non-corrosive sleeve comprises an oxidized exterior surface.

6. An imaging X-ray tube rotor assembly as in claim 1 wherein said slot is integrally formed with said rotor core and said bar is produced at least partially from a non-magnetic highly conductive material coupled to said slot.

7. An Imaging X-ray tube rotor assembly as in claim 6 wherein said non-magnetic highly conductive material comprises at least one of the following: copper, aluminum, silver, nickel, cobalt, and an alloy formed of two or more of the stated materials.

8. An imaging X-ray tube rotor assembly as in claim 1 further comprising:

a plurality of slots integrally formed with said rotor core; and a plurality of bars produced at least partially from a non-magnetic highly conductive material and coupled to said plurality of slots.

9. An imaging X-ray tube rotor assembly as in claim 8 wherein said non-magnetic highly conductive material comprises at least one of the following: copper, aluminum, silver, nickel, cobalt, and an alloy formed of two or more of the stated materials.

10. An imaging X-ray tube rotor assembly as in claim 1 wherein an exterior surface of said non-sprayed-on non-corrosive sleeve is oxidized via an induced oxidation process.

11. An imaging X-ray tube rotor assembly as in claim 1 wherein an exterior surface of said non-sprayed-on non-corrosive sleeve is non-oxidized.

12. An imaging X-ray tube rotor assembly as in claim 1 wherein said non-sprayed-on non-corrosive sleeve comprises approximately at least 12% chromium.

13. An imaging X-ray tube rotor assembly as in claim 1 wherein said non-sprayed-on non-corrosive sleeve comprises stainless steel.

14. An imaging X-ray tube rotor assembly as in claim 1 wherein said non-sprayed-on non-corrosive sleeve comprises an oxidized exterior surface generated by an induced greening effect.

15. An imaging X-ray tube rotor assembly for an imaging tube comprising;

a rotor core comprising;

at least one slot; and at least one bar;

a non-sprayed-on non-corrosive sleeve coupled to and at least partially covering said rotor core; and a sheet coupled to said rotor core and produced at least partially from a non-magnetic highly conductive material.

16. An imaging X-ray tube rotor assembly as in claim 15 wherein said non-magnetic highly conductive material comprises at least one of the following: copper, aluminum, silver, nickel, cobalt, and an alloy formed of two or more of the stated materials.

17. An imaging. X-ray tube rotor assembly comprising:

an x-ray tube rotor core produced at least partially from stainless steel and comprising:

a plurality of slots integrally formed with said rotor core; and a plurality of bars produced at least partially from a non-magnetic highly conductive material and coupled to said plurality of slots; and a non-sprayed-on sleeve in contact with, coupled over, and rotational wit said rotor core.

18. A method of producing an imaging X-ray tube rotor assembly comprising:

forming a rotor core at least partially from a non-corrosive material having at least one slot, wherein said rotor core and said at least one slot are integrally formed as a single component; and forming a sleeve produced at least partially from a non-magnetic, non-sprayed-on, and non-corrosive material directly over and in contact with said rotor core.

19. A method as in claim 18 wherein forming a rotor core comprises forming said rotor core at least partially from chromium.

20. A method as in claim 18 further comprising:

integrally forming a slot in said rotor core; and forming a bar within said slot and at least partially from a non-magnetic highly conductive material.

21. A method as in claim 18 further comprising:

integrally forming a plurality of slots in said rotor core; and forming bars within said plurality of slots and at least partially from a non-magnetic highly conductive material.

22. A method as in claim 18 further comprising systematically and actively oxidizing an exterior surface of the imaging tube rotor assembly.

23. A method of producing an imaging X-ray tube rotor assembly comprising:

forming a rotor core at least partially from a magnetic non-corrosive iron based material;

forming a sleeve produced at least partially from a non-magnetic, non-sprayed-on, and non-corrosive material directly over and in contact with said rotor core; and forming a sheet over said rotor core and at least partially from a non-magnetic highly conductive material.

24. A method of producing an imaging X-ray tube rotor assembly comprising:

forming a rotor core;

forming a sleeve over and in contact with said rotor core from at least partially a non-sprayed on non-corrosive material; and inducing oxidation of an exterior surface of said sleeve through applied heat.

* * * * *